United States Patent [19]

Willberg et al.

[11] Patent Number: 4,908,126

[45] Date of Patent: Mar. 13, 1990

[54] APPARATUS FOR TESTING AND SORTING ELECTRONIC COMPONENTS, IN PARTICULAR IC'S

[75] Inventors: Hans-Heinrich Willberg, Altoging/Bad Feilnbach; Ekkehard Ueberreiter, Raubling; Franz Schöttler, Grosskarolinenfeld, all of Fed. Rep. of Germany

[73] Assignee: Multitest, Elektronische Systeme GmbH, Rosenheim-Aisingerwies, Fed. Rep. of Germany

[21] Appl. No.: 118,957

[22] Filed: Nov. 10, 1987

[30] Foreign Application Priority Data

Nov. 11, 1986 [DE] Fed. Rep. of Germany ..... 3638430

[51] Int. Cl.[4] ..... B07C 5/344

[52] U.S. Cl. ..... 209/573; 324/158 F

[58] Field of Search ..... 209/573, 574; 324/73 AT, 158 F; 414/403, 404

[56] References Cited

U.S. PATENT DOCUMENTS

| | | | |
|---|---|---|---|
| 4,124,132 | 11/1978 | Pennings | 414/403 |
| 4,478,352 | 10/1984 | Amundson et al. | 209/573 X |
| 4,527,942 | 7/1985 | Smith . | |
| 4,589,815 | 5/1986 | Smith . | |
| 4,593,820 | 6/1986 | Antonie et al. | 209/573 |
| 4,694,964 | 9/1987 | Ueberreiter . | |

FOREIGN PATENT DOCUMENTS

| | | | |
|---|---|---|---|
| 0102217 | 3/1984 | European Pat. Off. . | |
| 3340183 | 5/1985 | Fed. Rep. of Germany . | |
| 0225882 | 8/1985 | Fed. Rep. of Germany | 324/158 F |
| 3615941 | 11/1987 | Fed. Rep. of Germany . | |
| 3615942 | 11/1987 | Fed. Rep. of Germany . | |
| 56-168566 | 12/1981 | Japan | 324/73 AT |
| 57-22570 | 2/1982 | Japan | 324/158 F |
| 57-199965 | 12/1982 | Japan | 324/158 F |
| 58-96258 | 6/1983 | Japan | 324/158 F |
| 61-86665 | 5/1986 | Japan | 324/158 F |
| 61-134684 | 6/1986 | Japan | 324/73 AT |
| 61-161465 | 7/1986 | Japan | 324/158 F |
| 61-228362 | 10/1986 | Japan | 324/158 F |
| 61-246675 | 11/1986 | Japan | 324/73 AT |
| 0513538 | 5/1976 | U.S.S.R. | 324/158 F |

*Primary Examiner*—Margaret A. Focarino
*Assistant Examiner*—Edward M. Wacyra
*Attorney, Agent, or Firm*—Scully, Scott, Murphy & Presser

[57] ABSTRACT

An apparatus for testing and sorting electronic components (33), in particular IC's, is directly mounted on the mounting (2*a*, 2*b* to 10*a*, 10*b*), preferably forming part of a manipulator, for a test computer. In order to convey the components (33) between an input magazine (16), a testing head (20) and an output magazine (17) a suction head (20) is provided which is movable on a carriage guide (15) and which may be lowered. The mounting forming part of the manipulator permits the test computer (1) and the whole apparatus arranged on a slope so that the components (33) in the magazine rods (26) of the input magazine (16) and the output magazine (17) slide forwards under gravity.

15 Claims, 6 Drawing Sheets

APPARATUS FOR TESTING AND SORTING ELECTRONIC COMPONENTS, IN PARTICULAR IC'S

TECHNICAL FIELD OF THE INVENTION

The invention relates to an apparatus for testing and sorting electronic components, in particular IC's, having an input magazine, with at least one magazine channel, for the components to be tested, a testing head for the components which are to be individually tested one after the other which has a socket with connection contacts, a test computer housed in a box-shaped casing which supplies test signals for the components to the testing head, an output magazine which has at least one magazine channel for the components found to be sound and at least one magazine channel for the components found to be faulty or poor, and at least one adjustable mounting for the box-shaped casing of the test computer.

BACKGROUND OF THE INVENTION AND PRIOR ART

An apparatus of this type is described in German Offenlegungsschrift No. 33 40 183. A mounting for the test computer in the form of a manipulator is described in the earlier German patent application Nos. P 36 15 941.7 and P 36 15 942.5 and also in EP-OS 0 102 217.

The testing apparatus known hitherto is distinguished by a high operating speed. Its input magazine, set obliquely, has a plurality of magazine channels and is displaceable transversely to the magazine channels in order to move a selected magazine channel into the unloading position. The latter moves the components it contains to a fixed separating device consisting of a conveyor belt with a light barrier. The separated components then drop into a test channel leading to a testing head. This has finger-like spring members connected to the test computer. After the testing process each tested component drops into a so-called sorting shuttle which is displaceable transversely to the magazine channels of the fixed output magazine and which unloads the component, depending on the test result, into one of the magazine channels. Here, too, the magazine channels are disposed obliquely. Filling of the magazine channels of the input magazine and emptying of the filled magazine channels of the output magazine is achieved by placing magazine rods on to the inputs of the magazine channels of the input magazine, or on to the outputs of the magazine channels of the output magazine, for the duration of the filling or unloading period. The testing apparatus is located in a separate casing and is an independent device. The test computer is similarly housed in a separate box-shaped casing. Since, on one hand, it is very heavy and the boxshaped casing is unwieldy, and on the other hand, the connection between test computer and testing head of the testing apparatus has to be made by corresponding plugs of plug contacts located on both devices which are susceptible to mechanical damage, the casing of the test computer is fixed in a manipulator. The manipulator is provided with a weight counterbalancing system and allows the test computer's casing to move in several degrees of freedom, so that the plug contacts of both devices can be engaged safely and without damage.

Since the known test apparatus was developed to achieve a high operating speed and to classify components found to be faulty as precisely as possible, it is obvious that this device calls for correspondingly great technical resources and is consequently expensive.

OBJECT OF THE INVENTION

The object of the invention is to provide an apparatus for testing and sorting electronic components, in particular IC's, which is able to operate with considerable fewer technical resources and is therefore cheaper to produce, accepting at the same time the fact that the operating speed is lower and sorting is less precise in its classification.

SUMMARY OF THE INVENTION

The object is achieved according to the invention by attaching the input magazine, testing head and output magazine to the casing of the test computer or to the mounting, and by providing a movable transfer element by which the components may be conveyed from the input magazine to the testing head and from the testing head to the output magazine.

Housing the testing apparatus in a separate casing is thus dispensed with. Instead, the parts of the apparatus are attached, releasably if desired, to the casing of the test computer or to the mounting for the casing.

Since, as described above, the manipulator permits the test computer casing to be moved into any position desired, this casing may, according to a development of the invention, also be so positioned that the input magazine and the output magazine are inclined or vertical, such that the components in the magazine channels slide forwards under gravity. The manipulator, present anyway to aid handling of the heavy test computer, may also be utilised to move the testing apparatus of the invention into a position which saves having the additional conveyor or sliding elements which would be necessary if the magazine channels were aligned horizontally. The manipulator even enables the inclination to be selected precisely so that the components are able to slide but only meet one another at moderate speed, thereby avoiding any damage.

One possible way of realising the fundamental idea of the invention may consist in attaching to the casing of the test computer or to the mounting for the casing a cross-piece with a carriage guide which overlaps the outlet of the input magazine, the testing head and the inlet of the outlet magazine, in disposing a sliding carriage movably on the carriage guide, in the sliding carriage carrying a suction head for the components to be conveyed which is movable towards the magazine and the testing head or away from them, and in providing a conveyor drive for the sliding carriage, a displacement drive for the suction head and a pneumatic control for the suction head.

For each magazine channel a separate delivery opening for the tested components may be provided at the outlet of the output magazine, the conveyor drive, displacement drive and pneumatic control being controlled by the computer or in dependance on the test result.

To ensure that a component picked up by the suction head is placed accurately in each case into the socket of the testing head or into the provided delivery opening of the output magazine, the suction head may have a suction nipple pointing downwards and capable of lateral deflection which allows for lateral tolerance movements of the component. In addition the socket of the testing head and the delivery openings for the components on the output magazine may be tapered.

To ensure that a component picked up by the suction head is safely but gently guided into the socket of the testing head or into the provided delivery opening of the output magazine, the suction head may, according to another development of the invention, be provided with at least one stop element intended to be superposed on a corresponding counter stop close to the outlet opening of the input magazine, the socket of the testing head and the delivery opening or openings of the output magazine, and the suction nipple may be movable against the resistance of a restoring force on the suction head and against the forwardly directed sliding movement of the suction head.

The input magazine may have at least two magazine channels and be arranged to be movable so that the removal opening of each magazine channel in turn is in a determined removal position. In this way one magazine channel may be filled and the other emptied. Another possible development of the invention is for the magazine channels in the magazine to consist of magazine rods which may be inserted into the magazines. This is particularly advantageous as the components normally have to be transported in magazine rods in any case.

Displaceable and lockable or sprung mounting or clamping elements may be provided as a mounting for magazine rods of varying width and height.

The removal opening at the end of each magazine channel of the input magazine may be composed of laterally or vertically adjustable limit elements which are set such that the removal opening is adapted to the length and width of the components to be removed.

As mentioned already, the adjustable mounting for the box-shaped casing of the test computer may be a manipulator. This, however, is not essential: it is equally possible to design the mounting merely so that it allows the manipulator to be placed on a table or the like, preferably in an inclined position.

Finally, in a last development of the invention the box-shaped casing of the test computer is enclosed by and is fixed in supporting side pieces, the supporting side pieces fit in or are part of the adjustable mounting, supporting elements projecting over the boxshaped casing are attached to opposite sides of the supporting side pieces, support rails for holding the magazines are fixed to the supporting elements and overlap the box-shaped casing, and further the crosspiece of the carriage guide is attached to the supporting elements.

BRIEF DESCRIPTION OF THE DRAWINGS

An exemplary embodiment of the invention will now be described with reference to the drawings, in which.

DETAILED DESCRIPTION OF A PREFERRED EMBODIMENT OF THE INVENTION

Figure 1:
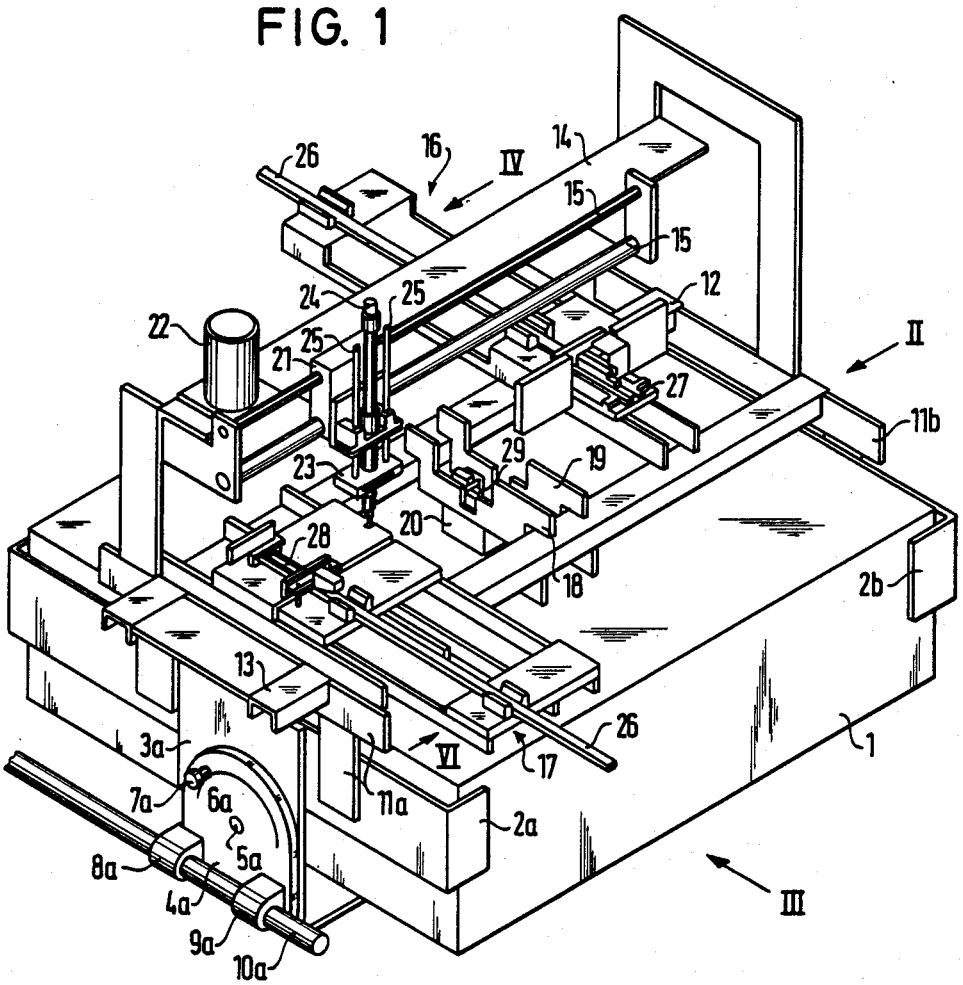
FIG. 1 shows a perspective view of the test computer casing which is held by a manipulator, only partially visible, and of the testing apparatus located on it.

In FIG. 1 the casing 1 containing the test computer is fixed between supporting side pieces 2*a*, 2*b* which are themselves rigidly connected to two plates of which only plate 3*a* is visible. Plate 3*a* abuts a further plate 4*a* and is joined to it by a swivelling axis 5*a*. The further plate 4 is provided with a semi-circular slot 6*a* through which a screw 7*a* projects and engages into the first-mentioned plate 3*a*. The plate 4*a* further bears two bearing bushes 8*a* and 9*a* with which it fits on a rod 10*a*. The test computer casing may be swivelled around the axis 5*a* and be fixed in a specific inclined position with the screw 7*a*. Parts 3*a* to 10*a* are present symmetrically on the other side (see FIG. 2) and are there given the same numbers but are designated "b". The parts mentioned, together with the supporting side pieces, are parts of a manipulator.

Fixed to the supporting pieces 2*a*, 2*b* are supporting elements 11*a*, 11*b* which project over the box-shaped casing 1 of the test computer. Support rails 12, 13 and a cross-piece 14 with a carriage guide 15 extend between the supporting elements 11*a* and 11*b*.

An input magazine 16 and an output magazine 17 are fixed on the support rails. Also fixed to the support rails 12, 13 are mountings 18, 19 for a testing head 20.

A sliding carriages 21 that can be displaced horizontally is disposed in the carriage guide 15. The drive is effected by a stepping motor 22 via a toothed belt drive, not shown. The drive motor 22 is seated on the cross-piece 14.

The sliding carriage 21 carries a suction head 23 which may be raised or lowered on guide rails 25 by means of a pneumatic lifting cylinder 24. The pneumatic supply lines for the lifting cylinder 24 and the suction head 23 and the vacuum source and corresponding control are not shown, as these are standard parts.

The input magazine 16 has two conventional rods 26, only one of which is depicted in FIG. 1. The components contained in the magazine rods 26 slide to the right to a removal opening 27 as a result of the inclined arrangement. As will be described in more detail later, the input magazine 16 is displaceable at right angles to the magazine rods such that one of the two magazine rods can always be moved into the unloading position whilst the other is being exchanged for a full magazine rod.

At least two magazine rods 26, only one of which is shown in FIG. 1, are put into the output magazine 17. A delivery opening 28 is provided for each of the interchangeable magazine rods 26. Because of the inclined arrangement the components deposited in the delivery opening 28 slide into the relevant magazine rod 26.

Testing and sorting using the apparatus represented in FIG. 1 takes place as follows: the sliding carriage 21 moves, with the suction head 23 raised, over the single removal opening 27 of the input magazine 16. When it reaches it, the suction head 23 is lowered and picks up the component waiting in the removal opening 27. The suction head with the component attached to it by suction is then raised. The sliding carriage is then moved into the position in which the suction head is above the socket 29 of the testing head 20. The suction head 23 with the component attached to it is then lowered so that the connection contacts of the component are brought into contact with the contacts of the socket 29. The test computer now feeds test signals to the component and evaluates the reaction. While the test result is being evaluated the suction head with the attached component is again raised and the sliding carriage is moved towards the output magazine 17. It stops over one of the delivery openings 28 of the output magazine. There the suction head 23 with the component attached to it is lowered. When the component is in the delivery opening 28 the suction is switched over to blow, with the result that the component is safely released from the suction head 23. This is then raised again and the sliding carriage is moved back to the starting position. The deposited component slides into the appropriate magazine rod 26.

Figure 2:
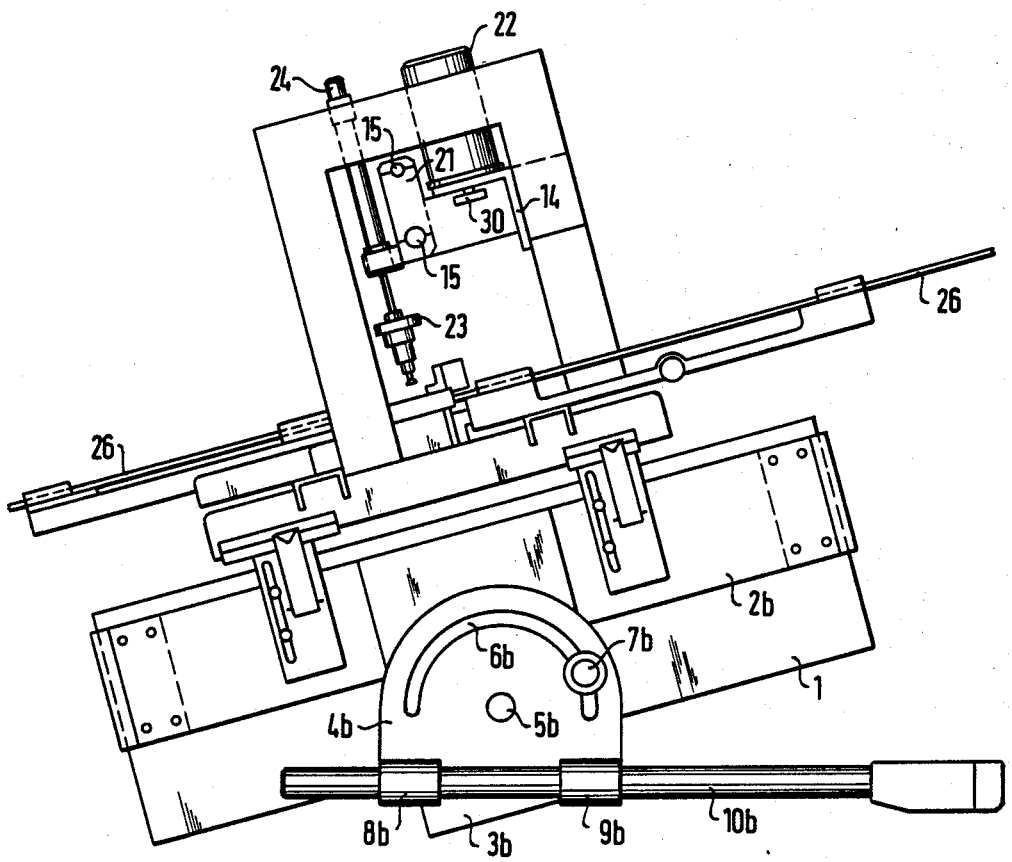
FIG. 2 shows a view II from FIG. 1.

The side view shown in FIG. 2 reveals the parts which are hidden in FIG. 1. Where these parts are paired with parts located on the other side they are given the same reference numeral but are designated "b". Also discernible is the gear wheel 30 of the drive motor 22 for the sliding carriage 21. Further, it is easy to see how the whole apparatus is inclined.

Figure 3:
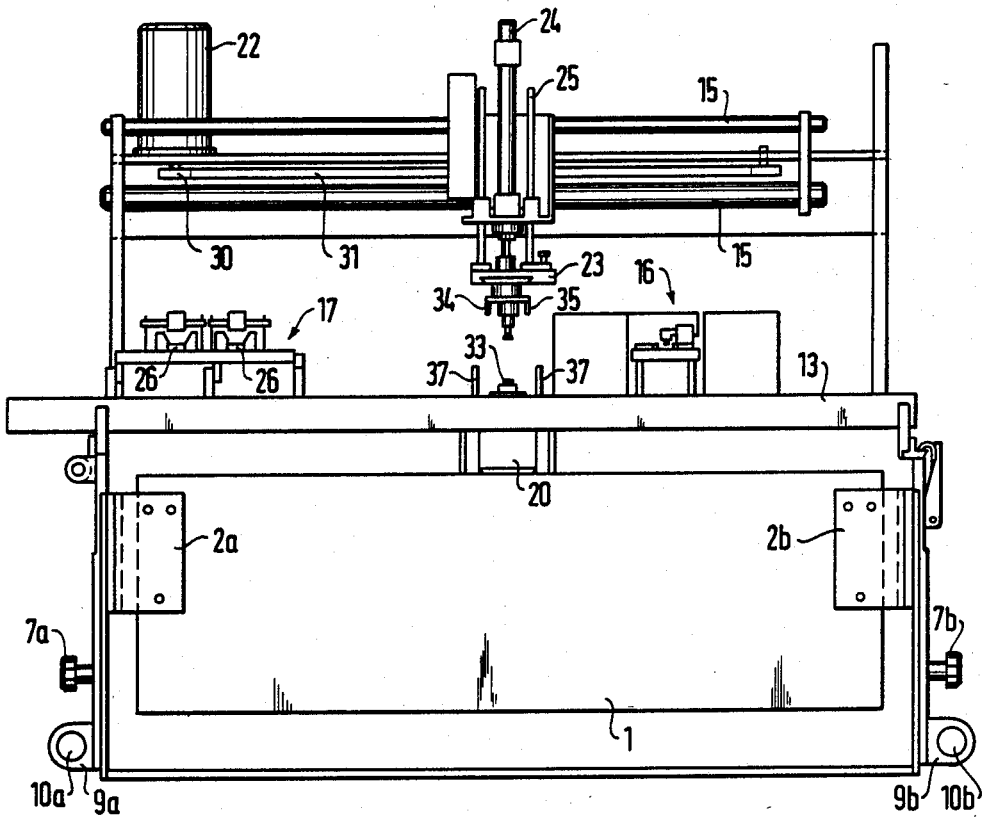
FIG. 3 shows a view III from FIG. 1.

As well as the gear wheel 30 of the drive motor 22, the frontal view according to FIG. 3 also shows the toothed belt 31 meshing with the gear wheel and connected to the sliding carriage 21. It can also be seen that the suction head 23 has an interchangeable part, represented in more detail in FIG. 8. This interchangeable part comprises two stop elements 34, 35 which correspond with equivalent counter stops 36, 37 close to the socket 29 of the testing head 20. Similar counter stops are also provided close to the removal opening of the input magazine 16 and the delivery openings of the output magazine 17. A component 33 placed in the socket 29 of the testing head 20 can also be seen.

Figure 4:
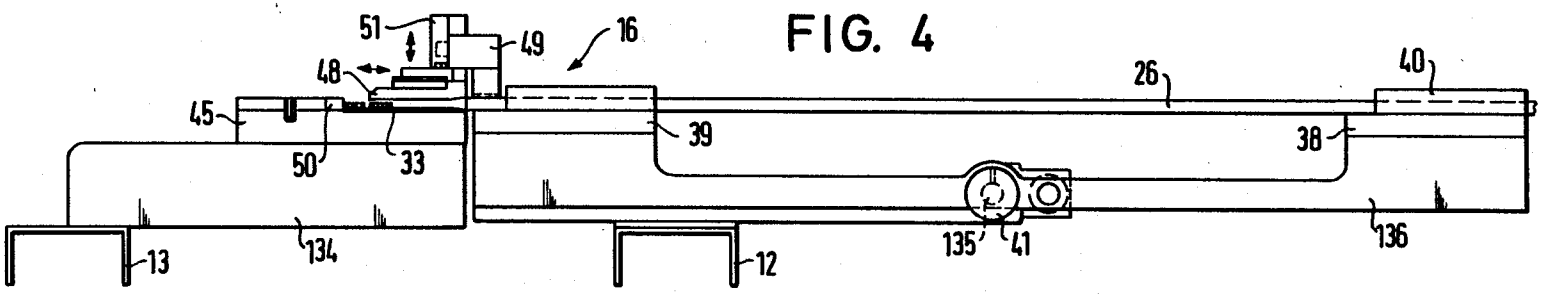
FIG 4 shows a view IV of the input magazine in FIG. 1.
Figure 5:
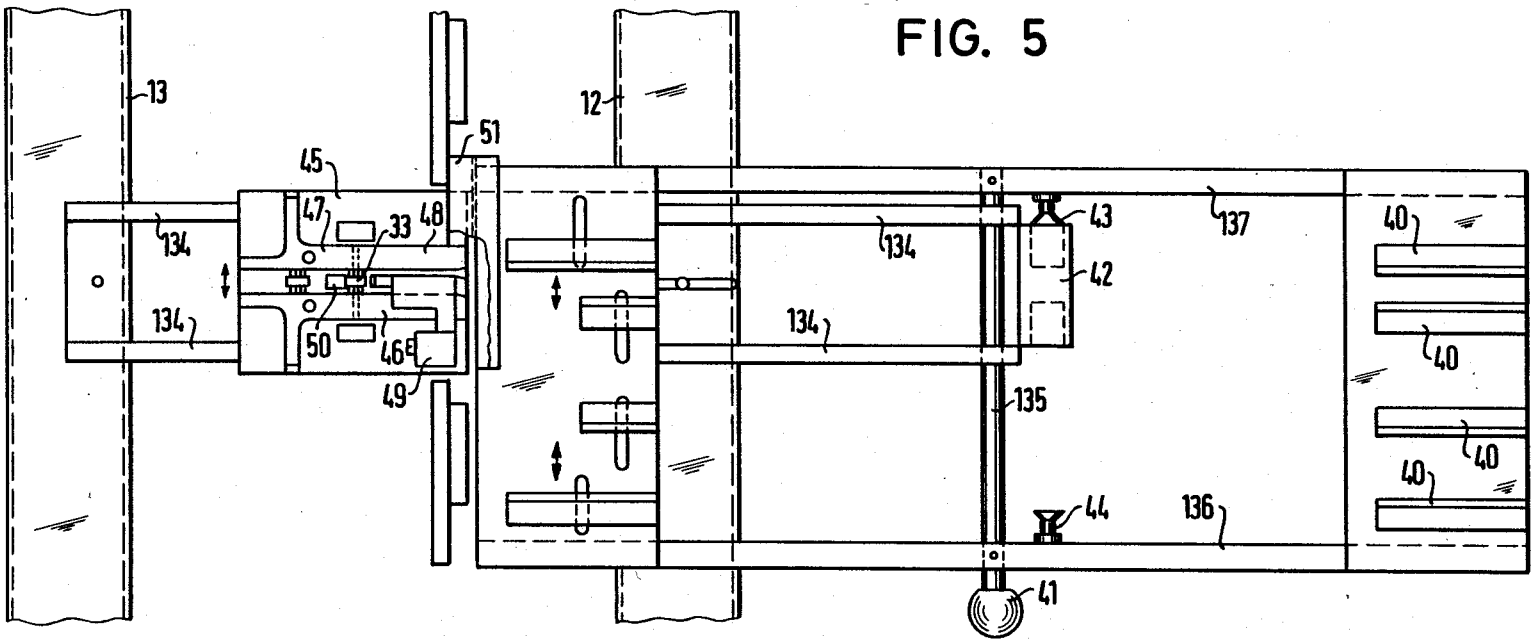
FIG. 5 shows a view of the input magazine from above.

The input magazine is shown on a larger scale in FIGS. 4 and 5. The side view in FIG. 4 shows the input magazine with the inserted magazine rods 26. In FIG. 5 no magazine rods are inserted.

The input magazine consists of a U-profiled frame 134 mounted on the rails 12, 13. A rod 135 extending between side walls 36, 37 passes through the frame 134. Mounted on the side walls 136, 137 are support plates 38, 39. Fitted on these are adjustable limiting elements 40 for the magazine rods 26 which are to be inserted. The rod 135 is provided at one end with a knob 41 which serves as a hand grip. By pushing against the knob 41 the attachment made up of parts 46 to 49 may be moved sideways relative to the frame 134 (the top of FIG. 5). Connected to the frame is a magnetic body 42 which cooperates with the magnetic counter parts 43, 44 on the two side walls 136, 137. In the case represented in FIG. 5 the magnetic body 42 is adhering to the counter part 43, preventing the magazine attachment made up of parts 46 to 49 from being moved inadvertently. The same applies when the attachment is in the other position.

Further located on the frame 134 is a removal base plate 45. Disposed on this are two movable limiting elements 46, 47 which are set at the prescribed distance apart by the interposition of a component 33. Above the inlet channel made up of the two lateral limiting elements 46, 47 is an upper limiting element 48 which is movable in a mounting 49 parallel to the inlet channel and also movable vertically over the inlet channel, as indicated by double arrows in FIG. 4. Further, there is a stop 50 in the inlet channel. By appropriately adjusting the distance of the upper limiting element 48 from the stop 50, the length of the removal openings may be adapted to the components to be removed. Adjusting the height of the limiting element 48 makes it possible to adapt to the height of the components. A component 33 is also shown in the removal openings. The components run obliquely downwards under gravity from the magazine rod aligned with the inlet channel into the inlet channel as far as the removal opening. Further attached to the mounting 49 is an upper limiting part 51 for the front end of the magazine rod 26 which is to be unloaded, which, as the double arrow indicates, is adjustable vertically.

Figure 6:
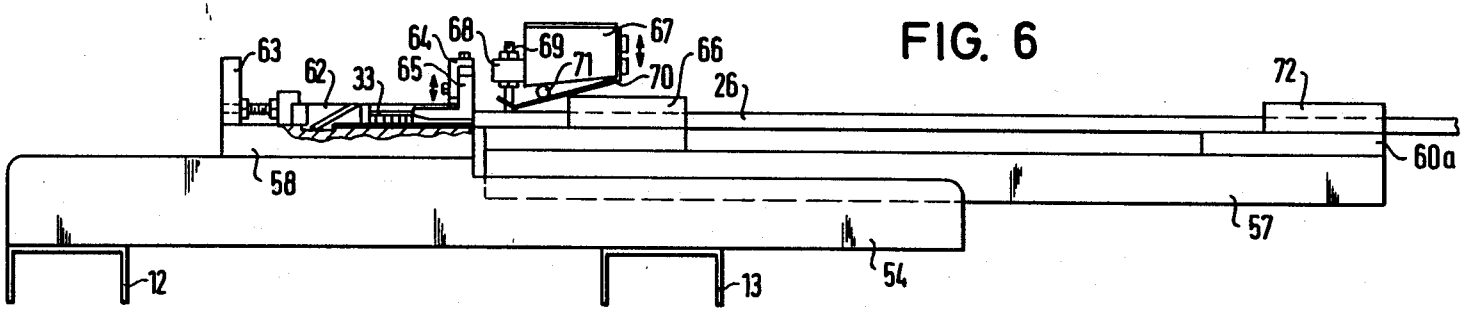
FIG. 6 shows a view VI of the output magazine in FIG. 1.
Figure 7:
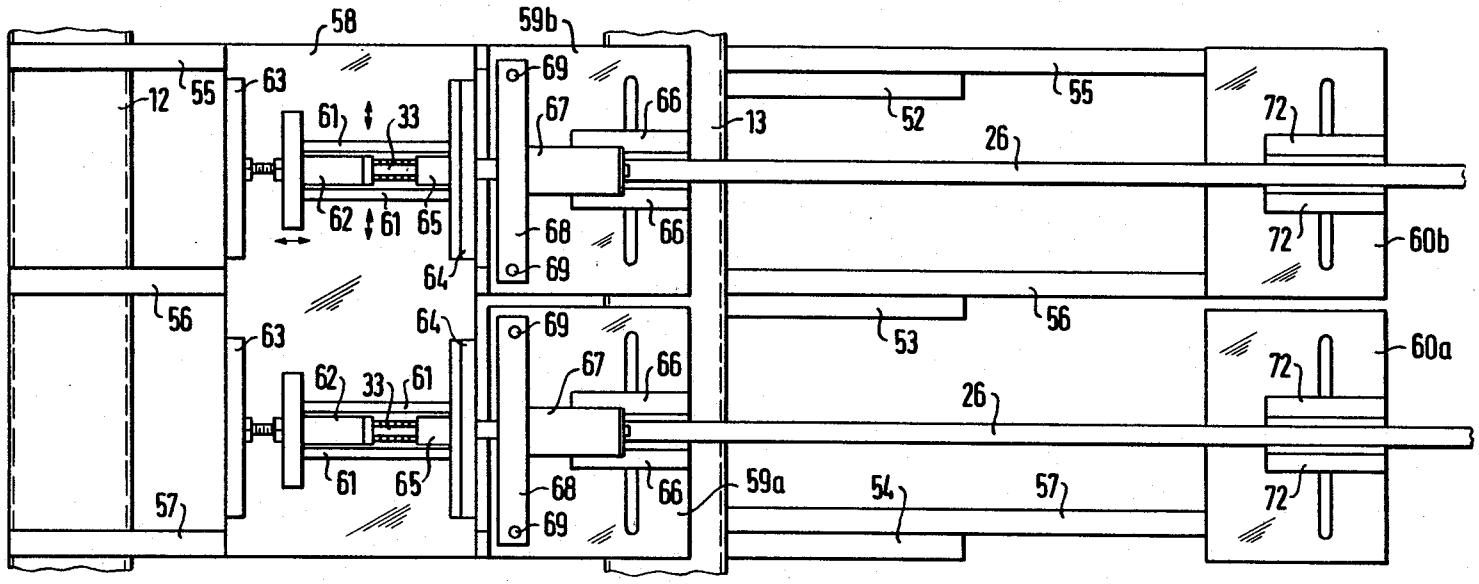
FIG. 7 shows a view of the output magazine from above.

The output magazine shown in FIGS. 6 and 7 has three support rails 52, 53, 54 fixed to the transverse rails 12, 13. Extension rails 55, 56, 57 are attached to the support rails 52, 53, 54. Placed on the across the support rails 52, 53, 54 is a plate 58. Mounted on the extensions 55, 56, 57 are firstly two part width plates **59*a*, 59*b* and secondly two part width plates 60*a* and 60*b***.

Disposed on the plate 58 are four lateral limiting elements 61 which delimit two delivery channels. The lateral limiting elements 61 are, as the double arrows indicate, laterally displaceable and are thus adaptable to the width of the components 33. Further longitudinally displaceable limiting elements 62 project into the delivery channels. They are supported on plates 63 disposed on the transverse plate 58. Disposed above the delivery channel are limiting elements 64 which are attached to a mounting 65, so as to be adjustable vertically. This is indicated by the double arrow in FIG. 6. The mounting 65 rests on the plate 58.

Lateral limiting elements 66 for the magazine rods 26 are fitted in their turn on the two plates **59*a*, 59*b*. These limiting elements 66 are laterally displaceable and may thereby be adapted to the width of the magazine rods 26. Further, each of the two plates 59*a*, 59*b* has a clamping body 67, fitted on a cross piece 68, which is attached to the plates 59*a*, 59*b* with screws 69, so as to be vertically movable, as the double arrow in FIG. 6 indicates. Located on the underside of the clamping body 67 is a leaf spring 70 which presses on the inlet end of the magazine rod 26 and thereby holds it stationary. A sensing element 71 of a microswitch abuts the leaf spring 70. The microswitch responds if the leaf spring 70 is not forced upwards by a magazine rod. In this case the testing operation is suspended so as to prevent components deposited in the delivery openings from striking a magazine rod when they slide downwards. Fixed to the plates 60*a*, 60*b* are again laterally displaceable limiting elements 72 between which the magazine rods 26** may be inserted.

Figure 8:
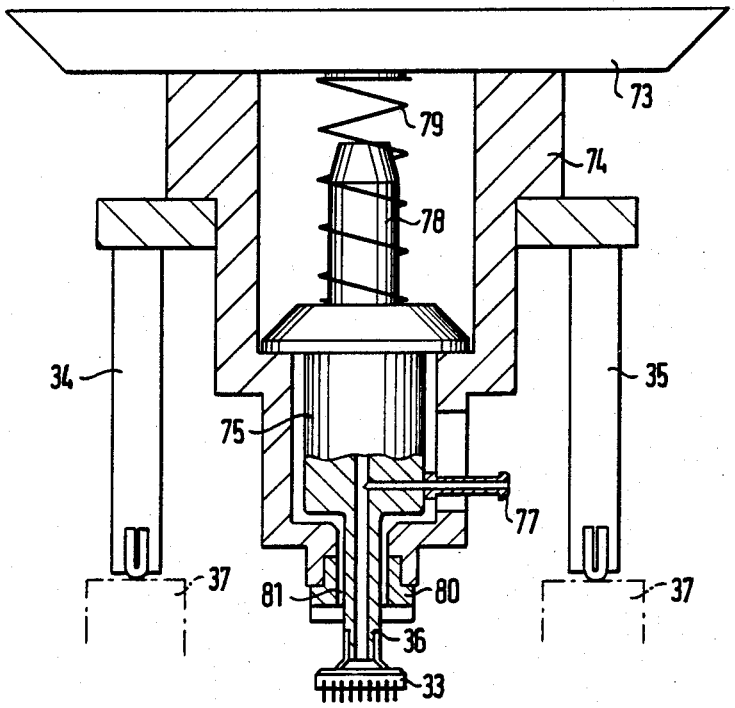
FIG. 8 shows a section through the interchangeable insert for the suction head.

The insert, shown in FIG. 8, for the suction head consists of a plug-in body 73 to which is attached a stepped receiving part 74 in the form of a hollow cylinder. Located in the hollow cylindrical receiving part 74 is a piston 75 with the suction nipple 36 which is connectible via a pneumatic connection 77 to an underpressure/overpressure source. The piston 75 has a pin 78 projecting upwards on which is fitted a compression coil spring 79 braced against the plug-in member 73.

Fitted at the lower end of the stepped hollow cylindrical receiving body 74 is a guide part 80 with a bore 81 through which the suction nipple 36 extends with clearance. This clearance allows for the lateral displacement of the suction nipple 36 which can thus compensate for tolerances when the component 33 is inserted into the socket of the testing head or into the delivery opening.

Located on the hollow cylindrical receiving body 74 are the stop elements 34, 35, already described in connection with FIG. 3.

It should be added also that the insert opening in the socket 29 of the testing head 20, and the delivery openings 28 (see FIG. 1) of the output magazine, which are not visible in the drawings, are tapered downwards with the result that here too the component 33 held by the suction nipple 36 can be guided with compensation for tolerances.

What is claimed is:

1. Apparatus for testing and sorting electronic components, comprising:

an input magazine, with at least one magazine channel for the components to be tested, a testing head for the components to be individually tested one after another and having a socket with connection contacts, a test computer to supply test signals to the testing head for the components, an output magazine having at least one magazine channel for the components found to be sound and at least one magazine channel for the components found to be faulty, and a movable transfer element for transporting the components from the input magazine to the testing head and from the testing head to the output magazine, the moveable transfer element including, (i) a carriage guide, and (ii) a carriage mounted on the carriage guide for sliding movement therealong, first, to carry the electronic components to the testing head from the input magazine, and to connect the electronic components to the testing head to receive the test signals therefrom, and second, after each electronic component has received the test signals, to carry the electronic component to the output magazine from the testing head, and to deposit the electronic component in the output magazine.

2. Apparatus according to claim 1, wherein:

the test computer includes a casing;

the apparatus further includes adjustable mounting means connected to said casing to vary an angle of inclination thereof; and the input magazine and the output magazine are connected to one of said casing and said adjustable mounting means;

whereby said input and output magazines are adapted to be inclined to permit gravity movement of the electronic components within the respective magazines.

3. Apparatus according to claim 1 or claim 2, wherein the transfer element further includes, a suction head for the components to be transported, a displacement drive and a pneumatic control for raising and lowering the suction head for picking up and releasing the components, and a conveyor drive for the sliding carriage for transporting the components.

4. Apparatus according to claim 3 wherein a respective delivery opening for the tested components is provided on each magazine channel of the output magazine; and the conveyor drive, the displacement drive and the pneumatic control are controlled by the computer.

5. Apparatus according to claim 4, wherein the suction head has a suction nipple pointing downwards and capable of lateral deflection, and the socket of the testing head and at least one of the delivery openings for the components provided on the output magazine are tapered.

6. Apparatus according to claim 5, wherein the input magazine has a removal opening to discharge the electronic components from the input magazine, the suction head is provided with at least one stop element, a respective one corresponding counter stop is provided close to each of the removal openings of the input magazine, the socket of the testing head and the delivery openings of the output magazine, the stop element of the suction head is adapted to be superposed on said corresponding counter stops, and the suction nipple is movable against the resistance of a restoring force on the suction head and against the downwards sliding movement of the suction head.

7. Apparatus according to claim 2, wherein the adjustable mounting means for the casing of the test computer includes means attached to the casing for swivelling the casing about an axis and for fixing the casing in a specific inclined position.

8. Apparatus according to claim 2, wherein the casing of the test computer is connected to supporting side-pieces, the supporting side-pieces being attached to the adjustable mounting means, supporting elements projecting over the casing are attached to the supporting side-pieces, support rails for holding the magazines are fixed to the supporting elements and overlap the casing, and a cross-piece of the carriage guide is attached to the supporting elements.

9. Apparatus according to claim 2 wherein the input magazine, the testing head and the output magazine are attached to the casing of the test computer.

10. Apparatus according to claim 1, wherein the input magazine has at least two magazine channels, each of the magazine channels of the input magazines is provided with a respective removal opening to discharge the electronic components from the magazine channel, and the input magazine is arranged to be movable such that each of the removal openings thereof is in a determined removal position.

11. Apparatus according to claim 1, wherein the magazine channels of the input and output magazines include magazine rods which may be inserted into the respective magazines.

12. Apparatus according to claim 11, wherein the input magazine has a removal opening to discharge the electronic components from the input magazine, and the removal opening is located at an end of the magazine channel of the input magazine and is defined by adjustable limit elements which are set such that the removal opening is adapted to the length and width of the components to be removed.

13. Apparatus according to claim 11 wherein the magazine rods of the input and output magazines are displaceably and lockably secured in their respective magazine.

14. Apparatus according to claim 1, wherein:

the test computer includes a casing;

the testing head is connected to the casing;

the carriage guide includes a guide rod connected to the casing in a fixed position relative to the casing, extending from a location adjacent the input magazine, past the testing head, and to a location adjacent the output magazine.

15. Apparatus according to claim 14, wherein:

the guide rod is a horizontal linear rod; and the carriage is mounted on the guide rod for horizontal sliding movement therealong from a first location directly above the input magazine, to a second location directly above the testing head, and to a third location directly above the output magazine.

* * * * *

UNITED STATES PATENT AND TRADEMARK OFFICE

CERTIFICATE OF CORRECTION

PATENT NO. : 4,908,126

DATED : March 13, 1990

INVENTOR(S) : Hans-Heinrich Willberg, et al.

It is certified that error appears in the above-identified patent and that said Letters Patent is hereby corrected as shown below:

Column 3, line 23: "magazine" should read as --magazines--

Column 3, line 46; "boxshaped" should read as --box-shaped--

Column 3, line 65: "a view" should read as --a side view--

Column 6, line 5: "shown" should read as --known--

Column 6, line 16, "on the across" should read as

--on and across--

Signed and Sealed this

Sixteenth Day of July, 1991

*Attest:*

HARRY F. MANBECK, JR.

*Attesting Officer*

*Commissioner of Patents and Trademarks*